United States Patent [19]

Davitt et al.

[11] 4,406,226

[45] Sep. 27, 1983

[54] NON-ELECTRIC DELAY BLASTING METHOD

[75] Inventors: Alan L. Davitt, Brownsburg; James R. Simon, Lachute, both of Canada

[73] Assignee: CXA Ltd./CXA Ltee, North York, Canada

[21] Appl. No.: 268,404

[22] Filed: May 29, 1981

[30] Foreign Application Priority Data

Dec. 9, 1980 [CA] Canada ..... 366417

[51] Int. Cl.[3] ..... F42B 3/00

[52] U.S. Cl. ..... 102/311; 102/313; 102/320; 299/13

[58] Field of Search ..... 102/301, 311, 312, 313, 102/320, 275.3, 275.7; 299/2, 13

[56] References Cited

U.S. PATENT DOCUMENTS

| | | | |
|---|---|---|---|
| 3,618,519 | 11/1971 | Griffith | 102/311 |
| 3,847,080 | 11/1974 | Eckels | 102/311 |
| 3,903,799 | 9/1975 | Walker | 102/311 |
| 3,987,733 | 10/1976 | Spraggs et al. | 102/275.3 X |
| 4,146,272 | 3/1979 | French | 102/311 X |
| 4,146,429 | 3/1979 | Slagley | 102/312 X |
| 4,194,789 | 3/1980 | Studebaker et al. | 102/314 X |
| 4,210,366 | 7/1980 | Hutchins et al. | 102/301 X |
| 4,326,752 | 4/1982 | Ricketts | 102/312 X |
| 4,347,789 | 9/1982 | Ricketts | 102/275.12 |
| 4,353,598 | 10/1982 | Ricketts | 102/312 X |

*Primary Examiner*—Peter A. Nelson

*Attorney, Agent, or Firm*—Donald G. Ballantyne

[57] ABSTRACT

A non-electric delay blasting method is provided which comprises the use of single trunk line of detonating cord having a series of detonating relays, all of the same delay period, connected at spaced intervals along its length. Branch lines of detonating cord are connected in groups to the trunk line in the intervals between the relays and each branch line has a delay detonator of the same delay period attached thereto. The delay period of the relays is shorter than that of the delay detonators. The detonators within the groups detonate in a random manner. The method eliminates the need to use large numbers of different delay period detonators in a multi-charge blast thus simplifying preparation of the charge and reducing inventories.

2 Claims, 3 Drawing Figures

NON-ELECTRIC DELAY BLASTING METHOD

Figure 1:
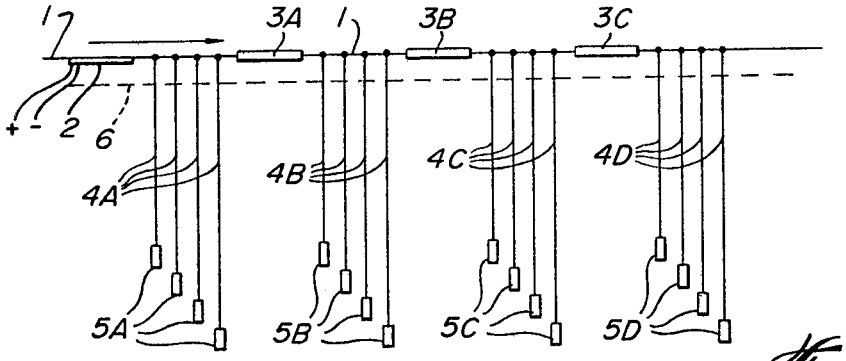

This invention relates to the art of blasting with explosives and, particularly, to a non-electric delay blasting method and a delay blasting assembly for use in the method employing low energy detonating cord or shock wave conductor and non-electric delay detonators.

The use of non-electric delay period detonators initiated by means of low energy detonating cord or low energy shock wave conductor as a replacement for electric caps and conductive wire initiation, is now widely used in blasting operations wherever hazards may be present due to stray electric currents. Such a non-electric delay blasting system is disclosed, for example, in British Pat. No. 858,794. A suitable type of delay detonator for use in a non-electric system is disclosed, for example, in Canadian Pat. No. 627,435.

To achieve the optimum effect from delay blasting techniques, which techniques are well known in the art, using non-electric systems, detonators are provided having a range of delay periods, usually from 0 to about 10 seconds. In the aforementioned British Pat. No. 858,794, for example, a non-electric delay blasting method is disclosed wherein each one of a series of explosive charges is initiated in predetermined sequence by means of a non-electric delay detonator of selected millisecond delay period, the detonators being separately set off by a connected length of low energy detonating cord (LEDC) and the separate lenth of detonating cord being, in turn, connected to a common energising source. In the operation of such a method, the various connected lengths of LEDC, upon initiation by the energising source, initiate nearly simultaneously the connected delay detonators. The delay detonators, after the selected delay interval, cause the initiation of the adjacent explosive charges. The system or method thus duplicates an electric delay blasting method except that the hazards associated with electric systems are eliminated.

In order to take full advantage of the improved rock breakage and displacement offered by the above-described milli-second delay blasting technique, it is essential that a large number of non-electric detonators having marginally different delay periods be employed. This requires that a large assortment of detonators having a range of delay periods be at hand for the blaster. For example, in the excavation of a medium sized tunnel in an underground working where a total of 40 drill-holes might be charged with explosives and fired in a single round, up to twelve or even more different time-delay detonators (delay period 1 to delay period 12) might be required for full effect. The selection and placement of the various detonators in such a blasting method is often time consuming and, in the environment of an underground working, detonators can be mismatched or placed in a wrong borehole resulting in poor blasting results.

It has now been found that all the advantages of non-electric delay blasting can be achieved and all the disadvantages associated therewith can be eliminated by employing a non-electric delay blasting assembly which comprises a length of first explosive connecting cord having detonating relays connected in series therealong at spaced intervals, said detonating relays all having the same delay period, one or more second lengths of explosive connecting cord attached in initiating contact wth the said first explosive connecting cord in the spaces between the said detonating relays, each of the said second explosive connecting cords having attached thereto in initiating relationship a non-electric delay detonator, all of the said delay detonators having the same delay period, the delay period of the said detonating relays being shorter than the delay period of the said non-electric delay detonators.

The non-electric delay blasting method of the invention comprises loading an explosive charge into a plurality of boreholes, providing non-electric delay detonators all of the same delay period in each of the said charged boreholes in initiating contact with said explosive charges, each of said delay detonators being separately attached in initiating relationship to a length of second explosive connecting cord extending beyond the mouth of the borehole and attached to a common initiating length of a first explosive connecting cord, the said common first explosive connecting cord having more than one detonating relay all of the same delay period, connected in series therealong at spaced intervals, the delay period of the said relays being shorter than that of the said delay detonators, the said connected second initiating cords being attached in groups to the said first connecting cord in the spaces between the said detonating relays so that upon initiation of the said first cord, groups of attached second explosive cords and associated delay detonators are initiated nearly simultaneously, the delay detonators within each said group detonating in a random manner to detonate the said explosive charges.

It is known that within any population of delay detonators having the same delay period, a certain scatter of delay times exists resulting from imperfections in assembly, size of components and the like. This normal variation in delay times is central to the blasting method of the present invention. Thus, in the present invention all shotholes contain the same assembly, that is, a long-period, non-electric delay detonator and an attached length of explosive connecting cord. The shotholes are divided into groups or 'rounds', each group or round being initiated at different time intervals through the use of in-series detonating relays located along the length of an energizer cord to which the connecting cords and delay detonators are attached. The interval between the detonation of individual delay detonators within a group or round occurs in a random manner resulting from the normal scatter of delay times found in any population of delay detonators. By using long period delay detonators, the magnitude of the scatter within each group or round is sufficient to prevent adverse effects such as excessive rock-throw or poor rock breakage, effects that would be expected should the shotholes in each round detonate simultaneously.

The invention is illustrated in the accompanying drawing wherein

Figure 2:
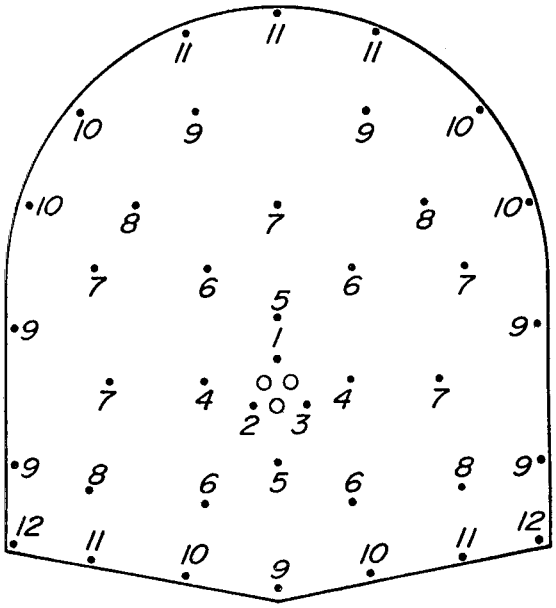
Figure 3:
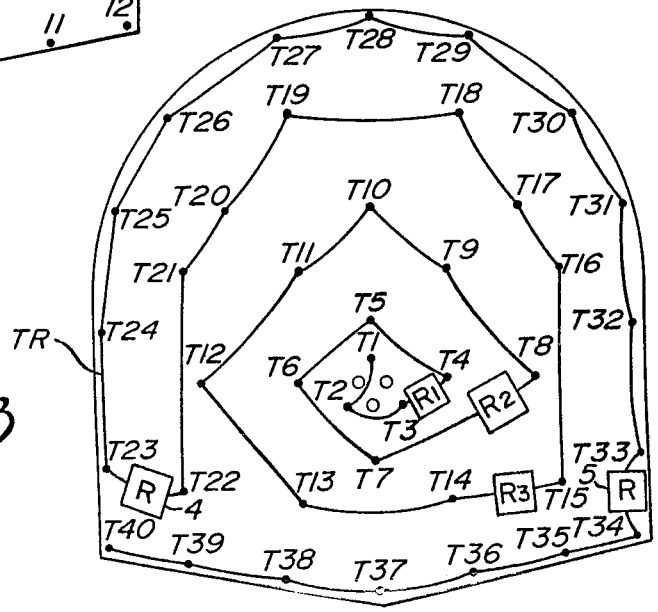

FIG. 1 is a diagrammatic depiction of a blasting layout according to the present invention showing the interconnection of the various explosive cords and delay components, FIG. 2 shows in front view a conventional tunnel blasting round employing a wide range of delay period detonators and FIG. 3 shows the same tunnel round as FIG., except that the method of this invention is employed.

Referring to FIG. 1, there is shown a trunk line 1 of standard detonating cord which is initiated by means of, for example, a blasting cap 2. Trunk line 1 has at intervals along its length series-connected detonating relays 3, all of the same delay period. Between relays 3 and attached to trunk line 1 are groups of low detonating cord or shock wave conductors 4. Attached to conductors 4 are non-electric delay detonators 5 all of the same delay period. In practice, trunk line 1 with its associated initiator 2 and in-series relays 3 are exposed or are on the surface of the ground or rock face (shown by dashed line 6) while conductor cords 4 with their attached delay detonators 5 are within boreholes (not shown) in initiating contact with explosive charges (not shown). The delay period of delay detonators 5 is chosen so as to be sufficiently long to permit the functioning of all surfaces relays 3 before any detonation of delay detonators 5 takes place. In the operation of the method depicted, trunk line 1 is energized by the detonation of cap 2, the detonation wave proceeding along trunk line 1 in the direction indicated by the arrow. Nearly instantaneously connecting cords 4*a* are initiated and these in turn activate attached delay detonators 5*a*. The detonation proceeding along trunk line 1 is delayed by series-connected relay 3*a* before it initiates the second group or round of connection cords 4*b* and activates delay detonators 5*b*. Similarly, a delay is provided by relays 3*b* and 3*c* prior to the initiation of cord groups 4*c* and 4*b* and their attached delay detonators 5*c* and 5*d*. It is essential for the proper functioning of the depicted system that the detonation of the entire trunk line 1, and its series-connected relays 3*a*, 3*b* and 3*c* occur before the detonation of any of the delay detonators 5, otherwise ground movement or rock throw could interrupt or cut off the detonation progression along trunk line 1. In a typical tunnel blasting operation of the kind described, detonating relays 3 for use on the trunk line 1 might be chosen with a delay period of 1000 milliseconds each while the delay period of the delay detonators 5 would appropriately be of the order of 8000 milliseconds thus assuring that none of delay detonators 5 will be detonated before the entire trunk line 1 is energized.

With reference to FIG. 2, which depicts a conventional delay blasting method, there is shown the face of a tunnel excavation in rock having 40 boreholes for explosive charges drilled therein. In addition, three uncharged holes, depicted by hollow circles, are shown towards the middle of the borehole pattern. The number opposite each of the charged boreholes indicates the delay period of the non-electric delay caps contained therein. Each delay cap is set off by means of a connected length of low energy connecting cord, (not shown) which cords are in turn connected to an initiating trunk line (not shown). Upon initiation of the trunk line, the delay detonators and their adjacent explosive charges are set off in the order of increasing delay time as shown. That is, the detonator with the delay period 1, close to the uncharged drillholes will be the first to detonate, followed by detonator of delay period 2, then delay period 3 and so on. In all, twelve different delay period detonators have been employed in this typical tunnel blast. This may be contrasted with the blasting technique depicted in FIG. 3 where the method of the present invention is employed in an identical 40-borehole blast. All boreholes contain the same delay period non-electric detonator, designated T, which are initiated by means of a trunk line TR through connected lengths of low energy connecting cord (not shown). Trunk line TR, at positions along its length, series-connected detonation relays R which interrupt the passage of a detonation wave along trunk line TR in a planned manner. Upon the energizing of trunk line TR, connected delay detonators T1, T2, and T3 are instantaneously activated while delay detonators T4, T5, T6 and T7 are activated at a later interval because of the delay created by the action of detonating relay R1. Activation of delay detonators T8, T9, T10, T11, T12, T13 and T14 are similarly further delayed by the action of detonating relay R2, and so on until all groups of delay detonators beyond each detonating relay are activated. Despite the fact that all delay detonators within a group (e.g. delay detonators T1, T2 and T3) are activated at the same time by trunk line TR, they will not necessarily detonate at the same instant due to the normal scatter to be found in any population of delay units. In an actual test which simulated the 40 hole tunnel blast depicted in FIG. 3 and where the blast was recorded by high speed movie film, the following sequence or order of detonations was observed: T2, T1, T3, T7, T5, T4, T6, T12, T11, T10, T14, T9, T8, T13, T22, T17, T16, T19, T20, T18, T21, T15, (T24 and T29), T23, (T28 and T30), T26, T27, T25, T32, T31, T33, T39, T40, T38, T34, T35, T36, T37. In the test NONEL (Reg. TM) delay detonators were employed which, based upon a sample of 50 test units from the same production run or population, had the following timing characteristics:

| | | |
|---|---|---|
| Mean delay time | 8115 | milliseconds |
| Min.-Max. | 7831-8322 | " |
| Scatter | 491 | " |
| Delay time coefficient of variation | 1.14% | |

Similarly the detonating relays employed were drawn from a population which, from a sample of ten units, had the following timing characteristics:

| | | |
|---|---|---|
| Mean delay time | 995 | milliseconds |
| Min.-Max. | 989-1013 | " |
| Scatter | 24 | " |
| Delay time coefficient of variation | 0.69% | |

In the method of the invention, the energizing trunk line normally comprises a length of conventional detonating cord having an explosive core containing approximately 15 grains of finely divided PETN or similar explosive per meter of length. The trunk line may be detonated by any conventional means. The detonating relays interposed in series along the trunk line are of the type disclosed for example, in U.S. Pat. No. 2,475,875. The chosen relays must not be so powerful so as to produce fragments which could sever undetonated lines. The connecting cord between the trunk line and the non-electric delay detonator may be either a low energy detonating cord (LEDC) having from 3 to 10 grains of explosive per meter of length or a NONEL (Reg. TM) shock wave conductor of the type described in U.S. Pat. No. 3,590,739. Suitable non-electric delay detonators for use with LEDC are described in the aforementioned British Pat. No. 858,794 and detonators for use with a shock wave conductor are described in U.S. Pat. No. 3,817,181.

The method of the invention thus provides a convenient, safe and practical means whereby non-electric delay blasting techniques maybe used without the need to employ a large assortment of delay detonators of different delay periods. The need to maintain large inventories of various delay period detonators is eliminated as is the time consuming procedure of loading boreholes with the appropriate delay period unit.

We claim:

1. A non-electric delay blasting assembly which comprises a length of first explosive connecting cord having detonating relays interconnected in series therealong at spaced intervals, said relays all having the same delay period, at least one length of second explosive connecting cord attached in initiating contact with the said first explosive connecting cord in the spaces between the said detonating relays, each of the said second explosive connecting cords having attached thereto in initiating relationship a non-electric delay detonator, all of the said delay detonators having the same delay period, the delay period of the said detonating relays being shorter than the delay period of the said non-electric delay detonators.

2. A non-electric delay blasting method which comprises loading an explosive charge into each of a plurality of boreholes, providing non-electric delay detonators all of the same delay period in each of the said charged boreholes in initiating contact with the said explosive charges, each of said delay detonators being separately attached in initiating relationship to a length of second explosive connecting cord extending beyond the mouth of the borehole and attached to a common initiating length of a first explosive connecting cord, the said first explosive connecting cord having more than one detonating relays all of the same delay period connected in series therealong at spaced intervals, the delay period of the said relays being shorter than the delay period of the said delay detonators, the said connected second initiating cords being attached in groups to the said first connecting cord in the spaces between the said detonating relays so that upon initiation of the said first initiating cord the said attached second cord groups and associated delay detonators are initiated nearly simultaneously, the said delay detonators within each said group detonating in a random manner to detonate the said explosive charges.

* * * * *